US006723178B1

(12) United States Patent
Bannai et al.

(10) Patent No.: US 6,723,178 B1
(45) Date of Patent: Apr. 20, 2004

(54) PROCESS FOR FORMING A PHOSPHATE CONVERSION COATING ON METAL

(75) Inventors: Hirokatsu Bannai, Hiratsuka (JP); Yasuhiko Nagashima, Nagoya (JP); Takaomi Nakayama, Hiratsuka (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 10/049,767

(22) PCT Filed: Aug. 16, 2000

(86) PCT No.: PCT/US00/22335

§ 371 (c)(1), (2), (4) Date: Jan. 19, 2002

(87) PCT Pub. No.: WO01/12341

PCT Pub. Date: Feb. 22, 2001

(30) Foreign Application Priority Data

Aug. 16, 1999 (JP) ..... H11-230060

(51) Int. Cl.[7] ..... C23C 22/07; B05D 3/10

(52) U.S. Cl. ..... 148/253; 148/254; 148/262; 148/263; 427/327; 427/328

(58) Field of Search ..... 427/327, 328, 427/430.1, 435; 148/253, 254, 262, 263

(56) References Cited

U.S. PATENT DOCUMENTS

| | | | | |
|---|---|---|---|---|
| 3,395,052 A | | 7/1968 | Yonezaki et al. | 148/6.15 |
| 4,717,431 A | * | 1/1988 | Knaster et al. | 428/628 |
| 5,326,408 A | | 7/1994 | Cormier | 148/254 |
| 5,494,504 A | | 2/1996 | Wright | 106/14.12 |
| 6,197,126 B1 | | 3/2001 | Roland et al. | 148/262 |
| 6,478,860 B1 | * | 11/2002 | Nakayama et al. | 106/14.05 |

FOREIGN PATENT DOCUMENTS

| | | | |
|---|---|---|---|
| WO | WO 98/39498 | | 9/1998 |
| WO | WO 00/05066 A | * | 2/2000 |

* cited by examiner

*Primary Examiner*—Michael Barr
(74) *Attorney, Agent, or Firm*—Stephen D. Harper; Mary K. Cameron

(57) ABSTRACT

A metal surface on which a phosphate conversion coating is to be formed and which has been surface conditioned by contact with a liquid surface conditioner composition that contains dispersed fine particles of solid phosphate of at least one divalent or trivalent cations type and an adhesion promoting agent. After such conditioning, a very high quality conversion coating can be formed on the surface by contact with a nickel-free liquid phosphating composition that contains at least acid, zinc cations, and phosphate anions and optionally and preferably also contains other materials.

10 Claims, No Drawings

PROCESS FOR FORMING A PHOSPHATE CONVERSION COATING ON METAL

This application claims priority from International Application No. PCT/US00/22335, filed Aug. 16, 2000 and published in English, and Japanese Application No. H11-230060, filed Aug. 16, 1999.

FIELD AND BACKGROUND OF THE INVENTION

This invention relates to processes for the phosphate conversion treatment of metals wherein said processes employ a nickel ion-free phosphate conversion treatment bath and produce a uniform, strongly paint-adherent, and highly post-painting corrosion-resistant coating on such metals as steel sheet, zinc-plated steel sheet, aluminum alloys, and magnesium alloys.

Phosphate conversion treatments are currently executed as a pre-paint treatment on automotive body components in order to enhance corrosion resistance and improve the steel sheet-to-paint adherence. In these phosphate conversion treatments, the metal is first brought into contact with a colloidal titanium surface conditioning bath and is then brought into contact with an acidic solution containing phosphate ions, zinc ions, nickel ions, and manganese ions in order to precipitate a phosphate coating on the metal.

However, in association with today's heightened concern with environmental protection, the regulatory situation with regard to nickel in wastewater has become increasingly stringent, particularly in Europe. It is certainly prudent to anticipate that regulations on nickel in wastewater might also become much more demanding in other countries in the future. These considerations make it desirable to eliminate the nickel from the conversion treatment baths used in zinc phosphate treatments.

Unfortunately, a number of negative effects are caused by removal of the nickel from many phosphate treatment baths used in the aforementioned phosphate treatment processes: The crystals in the phosphate coating undergo coarsening: the phosphate coating suffers from a loss of uniformity, the post-painting corrosion resistance declines, and the secondary (water-resistant) adherence of paint to zinc-plated material also declines, Japanese Laid Open Patent Application (PCT) Number Hei 7-505445 (505,445/1995) teaches a nickel-free phosphate treatment process in order to solve the problems referenced above. This treatment process involves formation of a nickel-free phosphate coating by treatment with a phosphate conversion bath containing 0.2 to 2 grams of zinc ions per liter of bath (this unit of concentration being freely used hereinafter for any constituent of any liquid and being usually abbreviated as "g/l"), 0.5 to 25 milligrams of copper ions per liter, and 5 to 30 g/l phosphate ions. This process uses copper as a substitute metal for nickel, but still suffers from several problems. Since the allowable copper level in this conversion treatment bath is so very low, management of the copper concentration in real-world lines is exceedingly difficult. Another concern is with electrolytic corrosion of the equipment accompanied by displacement copper plating on parts of the equipment.

Given this background, there is a desire for development of a phosphate conversion treatment process that does not use nickel but nevertheless affords a post-painting adherence and post-painting corrosion resistance that are the equal of those afforded by existing phosphate conversion treatments that use nickel. One major object of this invention is to provide a phosphate conversion treatment process that treats metal surfaces with a nickel-free conversion treatment bath and produces a phosphate conversion coating that evidences an excellent post-painting corrosion resistance and excellent paint adherence.

BRIEF SUMMARY OF THE INVENTION

It has been found that most or all of the problems caused by the removal of nickel from previous phosphating treatments can be eliminated by using a surface conditioning composition that contains very fine, dispersed solid phosphate particles.

DETAILED DESCRIPTION OF THE INVENTION AND PREFERRED EMBODIMENTS

More specifically, a process according to the invention for forming a phosphate conversion on a metal substrate surface comprises, preferably consists essentially of, or more preferably consists of the following operations:

(I) contacting the metal substrate surface with an aqueous liquid surface conditioning composition (hereinafter for brevity often called a "bath" without intending any implication that it must be contacted with the metal substrate by immersion of the metal substrate in a volume of the aqueous liquid surface conditioning composition) that comprises, preferably consists essentially of, or more preferably consists of, water and the following components:

(I.A) dispersed solid phosphate particles that:

(i) have a diameter no greater than 5 micrometres, this unit of length being hereinafter usually abbreviated as "$\mu$m"; and (ii) comprise, preferably consist essentially of, or more preferably consist of, at least one substance selected from the group consisting of phosphates that contain at least one divalent or trivalent metal cation; and (I.B) as adhesion-promoting component, at least one selection from the group consisting of the following subgroups:

(1) monosaccharides, polysaccharides, and derivatives thereof;

(2) phosphorus containing solutes selected from the group consisting of orthophosphoric acid, condensed phosphoric acids, and organophosphonic acid compounds;

(3) water-soluble polymers that are homopolymers or copolymers of vinyl acetate and derivatives of these homopolymers and copolymers; and (4) copolymers and polymers as afforded by the polymerization of:

(a) at least one selection from:

monomers, exclusive of vinyl acetate, that conform to general chemical formula (I):

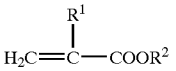

(I), where $R^1$=H or $CH_3$ and $R^2$=H, $C_1$ to $C_5$ alkyl or $C_1$ to $C_5$ hydroxyalkyl; and other $\alpha,\beta$-unsaturated carboxylic acid monomers; and, optionally, (b) not more than 50 % by weight of monomers that are not vinyl acetate and are not within the description of part (a) immediately above but are copolymerizable with said monomers that are within the description of said part (a); and (II) contacting the metal substrate surface as conditioned in operation (I) as described above with a nickel-free phosphate conversion treatment bath that comprises, preferably consists essentially of, or more preferably consists of water and the following amounts of the following components:

(II.A) from 0.5 to 5 g/l of zinc cations;

(II.B) from 5 to 30 g/l of phosphate ions; and (II.C) a component of conversion accelerator.

In a preferred embodiment, the above-specified conversion treatment baths also contain from 0.1 to 3.0 g/l of at least one type of metal containing ions selected from the group consisting of magnesium ions, cobalt ions, manganese ions, calcium ions, tungstate ions, and strontium ions.

The features of this invention are explained in greater detail hereinbelow. Whenever a group of materials from which a constituent can be selected is specified, whether by a specific list, use of generic chemical terms, and/or conformance to a general chemical formula, any two or more of the group may be selected instead of a single member with equal preference unless explicitly stated otherwise.

While no particular limitations apply to the metal on which the inventive phosphate-treatment process may be executed, this metal is preferably steel sheet, zinc-plated steel sheet, zinc alloy-plated steel sheet, magnesium alloy, or aluminum alloy.

It is preferred in the practice of the invention that the metal substrate surface be clean prior to the phosphate conversion treatment. Metal whose surface is already clean can be brought without further treatment into contact with the surface conditioning bath. However, in the case of treatment of metal whose surface is contaminated with adherent materials such as iron particles, dust, and oil, the contaminants adhering on the surface should be removed by cleaning, for example, by cleaning with a water-based alkaline degreaser or an emulsion degreaser or by solvent degreasing. When a water-based cleaner is used, the cleaning bath remaining on the metal surface is preferably removed by the provision of, for example, a water rinse step after the cleaning step.

At least some of the particles of divalent and/or trivalent metal phosphate present in a surface conditioning bath in a process according to the invention must have a particle size or diameter no greater than 5 $\mu$m. (Insolubles of larger size are undesirable because—depending on the particular circumstances—they often cannot be stably maintained in the aqueous bath.) These phosphate particles are believed to function as nuclei during phosphate crystal deposition and also to promote the deposition reaction itself, by undergoing partial dissolution in the phosphate conversion treatment bath and inducing a substantial acceleration of the initial phosphate crystal deposition reactions by supplying one or more main components of the phosphate crystals to the region immediately adjacent to the metal surface.

The divalent and trivalent metals used here are not critical, but preferably comprise at least one selection from Zn, Fe, Mn, Co, Ca, Mg, and Al. The divalent and/or trivalent metal phosphate particles are preferably present at a concentration from 0.001 to 30 g/l. Acceleration of the initial phosphate crystal deposition reactions does not normally occur at a divalent and/or trivalent metal phosphate particle concentration below 0.001 g/l due to the small amount of divalent and/or trivalent metal phosphate particles that become adsorbed on the metal surface at such low concentrations. Concentrations below 0.001 g/l also prevent acceleration of the crystal deposition reactions due to the small number of divalent and/or trivalent metal phosphate particles available to act as crystal nuclei. Divalent and/or trivalent metal phosphate particle concentrations in excess of 30 g/l cannot be expected to provide additional promotion of the phosphate conversion reactions and hence will be uneconomical.

The adhesion-promoting component that must be present in the inventive surface conditioning bath functions to improve the dispersion stability of the divalent and/or trivalent metal phosphate particles and to accelerate adsorption of the divalent and/or trivalent metal phosphate particles onto the metal surface. More specifically, the adhesion promoting component is believed to adsorb on the surface of the divalent and/or trivalent metal phosphate particles and, through a steric hindrance activity and repulsive forces arising from its electrical charge, to prevent collisions among the divalent and/or trivalent metal phosphate particles in the surface conditioning bath and thereby inhibit their aggregation and sedirmentation. In addition, due to its structure, the adhesion-promotng component itself is believed to have an ability to adsorb to metal surfaces and thereby to accelerate adsorption to metal surfaces by the divalent and/or trivalent metal phosphate particles, so that the surface conditioning activity. manifests upon contact between the metal workpiece and surface conditioning bath.

The adhesion-promoting component concentration is preferably from 1 to 2,000 parts by weight of the adhesion promoting component per 1000 parts by weight of the total conditioning composition, this unit of concentration being hereinafter usually abbreviated as "ppm". At concentrations below 1 ppm a surface conditioning activity can not usually be produced just by contact between the metal workpiece and the surface conditioning bath. Not only can no additional benefit be expected at concentrations in excess of 2,000 ppm, but such concentrations can impair the phosphate conversion coating formed, perhaps as a result of excessive adsorption of the adhesion promoting component on the metal substrate surface.

A saccharide type of adhesion-promoting component for the surface conditioning operation in a process according to the invention may be exemplified by fructose, tagatose, psicose, sorbose, erythrose, threose, ribose, arabinose, xylose, lyxose, allose, altrose, glucose, mannose, gulose, idose, galactose, talose, and the sodium and ammonium salts of all of these saccharides.

A phosphorus containing acid type of adhesion-promoting component in the surface conditioning process is exemplified by orthophosphoric acid, polyphosphoric acids, and organophosphonic acid compounds, or more individually by pyrophosphoric acid, triphosphoric acid, trimetaphosphoric acid, tetrametaphosphoric acid, hexametaphosphoric acid, aminotrimethylenephosphonic acid, 1-hydrbxyethylidene-1, 1-diphosphonic acid, ethylenediaminetetramethylenephosphonic acid, diethylenetriaminepentamethylenephosphonic acid, and the sodium and ammonium salts of all of the preceding acids. Sodium salts are preferred for the organophosphonic acids if they are to be used in salt form.

Polymeric adhesion promoting components derived from polyvinylacetate in a surface conditioning operation in a process according to the invention are exemplified by polyvinyl alcohols afforded by the hydrolysis of vinyl acetate polymers, cyanoethylated polyvinyl alcohols afforded by the cyanoethylation of polyvinyl alcohol with acrylonitrile, formalated polyvinyl alcohols afforded by the acetalation of polyvinyl alcohol with formaldehyde, urethanized polyvinyl alcohols afforded by the urethanation of polyvinyl alcohol with urea, and water-soluble polymers afforded by the introduction of carboxyl moieties, sulfonic moieties, or amide moieties into polyvinyl alcohol. Suitable vinyl acetate-copolymerizable monomers are exemplified by acrylic acid, crotonic acid, and maleic anhydride. The effects associated with the present invention will be fully manifested as long as the vinyl acetate polymer or derivative thereof or the copolymer of vinyl acetate and vinyl acetate-copolymerizable monomer is soluble in water. Within this limitation, these effects are independent of the degree of polymerization and the degree of functional group introduction of the subject polymers.

Suitable monomers for other polymeric adhesion promoting components for the surface conditioning operation are exemplifed by: methyl acrylate, ethyl acrylate, propyl acrylate, butyl acrylate, pentyl acrylate, hydroxymethyl acrylate, hydroxyethyl acrylate, hydroxypropyl acrylate, hydroxybutyl acrylate, hydroxypentyl acrylate, hydroxymethyl methacrylate, hydroxyethyl methacrylate, hydroxypropyl methacrylate, hydroxybutyl methacrylate, and hydroxypentyl methacrylate as examples of polymers according to formula (I); acrylic acid, methacrylic acid, and maleic acid as unsaturated adds; and styrene, vinyl chloride, and vinylsulfonic acid as optional comonomers.

A surface conditioning bath used by the inventive phosphate treatment processes can also optionally contain an alkali metal salt or ammonium salt or a mixture thereof, selected from the group consisting of orthophosphate salts, metaphosphate salts, orthosilicate salts, metasilicate salts, carbonate salts, bicarbonate salts, nitrate salts, nitrite salts, sulfate salts, borate salts, organic acid salts, and combinations of two or more selections from the aforesaid alkali metal and ammonium salts. The concentration of this component is not critical, but when used is preferably from 0.5 to 20 g/l. The surface conditioning bath may also contain a surfactant to promote uniform wetting of the surface being treated.

The phosphate conversion treatment process of this invention will now be considered in greater detail. A zinc ions concentration below 0.5 g/l, because it can prevent the formation of a coating of acceptable weight and can result in a diminished coverage ratio by the deposited phosphate crystals, can produce an inadequate post-painting corrosion resistance. A zinc ions concentration in excess of 5.0 g/l can cause a coarsening of the coating crystals, resulting in particular in a decline in the post-painting adherence. The use of a phosphate ions concentration below 5.0 g/l strongly impairs the production of a normal conversion coating. Concentrations in excess of 30.0 g/l are uneconomical since they provide no additional effect. Phosphate ions can be supplied by the addition of phosphoric acid or its aqueous solution to the phosphate conversion treatment bath or by the dissolution of, for example, sodium, magnesium, or zinc phosphate in the phosphate conversion treatment bath.

The conversion treatment bath also contains a component known as a "conversion accelerator" or simply "accelerator". The accelerator acts to restrain gaseous hydrogen production during etching, an action sometimes called "depolarizing" the metal substrate surface. Otherwise, however, no particular limitations apply to the accelerator; and any material or combination of materials recognized as a conversion accelerator in prior art may be used.

The phosphate conversion treatment bath of this invention can also contain from 0.1 to 3.0 g/l of at least one type of metal containing ions selected from the group consisting of magnesium cations, cobalt cations, manganese cations, calcium cations, tungstate anions, and strontium cations. The presence of this component in the phosphate conversion treatment bath, through its incorporation into the phosphate coating and through its precipitation in a form separate from the phosphate, provides additional performance enhancements in the post-painting corrosion resistance and post-painting adherence, respectively. The use of a concentration below 0.1 g/l usually does not effect any improvement in painting performance. A concentration above 3.0 g/l is economically wasteful, since no additional improvements in painting performance usually results; a high concentration can actually hinder deposition of the zinc phosphate that is the main component of an effectively protective conversion coating produced according to this invention. The source of one of the types of metal cations can be, for example, an oxide, hydroxide, carbonate, sulfate, nitrate, or phosphate of the particular metal. The source of tungstate can be, for example, the sodium or potassium salt.

An etchant may be added to the phosphate conversion treatment bath in order to induce a uniform etch of the surface of the metal workpiece. Usable as this etchant are, for example, fluoride ions and complex fluoride ions such as fluorosilicate ions. The fluorine compound used here can be, for example, hydrofluoric acid, fluorosilicic acid, or a water soluble metal saft (e.g., sodium salt, potassium salt) of the preceding.

The phosphate conversion treatment can be carried out by immersion or spraying or some combination thereof. Treatment for about 1 to 5 minutes can form a conversion coating satisfactorily robust for practical applications. The temperature of the phosphate conversion treatment bath is preferably from 30 to 60° C.

The phosphate conversion treatment is preferably followed by at least one water rinse, and deionized water is preferably used in the final water rinse.

Working and comparative examples of actual treatments are provided below in order to demonstrate the advantageous effects of this invention in specific terms. The working examples that follow are simply examples of the application of the invention, and in no way limit the applications of the invention or materials usable in the application of the invention.

Materials Tested

The following metal substrates were treated in the working and comparative examples: electrogalvanized steel sheet ("EG"), sheet thickness=0.8 millimeters (hereinafter usually abbreviated as "mm"), plating add-on=20 grams of plated zinc per square meter of sheet surface, this unit of coating weight being hereinafter freely used for any coating on any surface and being hereinafter usually abbreviated as "g/m$^2$; galvannealed hot-dip galvanized steel sheet ("GA"), sheet thickness=0.8 mm, coating add-on=45 g/m$^2$; and cold-rolled steel sheet ("CRS"), sheet thickness=0.8 mm, type SPCC-SD.

Treatment operations sequence (common to the working and comparative examples; as noted in the description of the testing below, not all of the specimens tested were subjected to the operations numbered 8 or higher)

(1) Degreasing with diluted FINECLEANER® L4460 alkaline degreaser concentrate, a product of Nihon Parkerizing Co., Ltd., the working degreaser containing 20 g/l of agent A and 12 g/l of agent B, 43° C., 120 seconds, dipping.

(2) Water rinse with tapwater ambient temperature, 30 seconds, spray.

(3) Surface conditioning

The conditions are described below in the tables for the working and comparative examples. The colloidal titanium surface conditioning treatments were run using PREPALENE® ZN, a product of Nihon Parkerizing Co., Ltd.

(4) Phosphate conversion treatment

The conditions are described below in the tables for the working and comparative examples. The treatment time was 120 seconds in all cases.

(5) Water rinse (tapwater): ambient temperature, 30 seconds, spray (6) Deionized water rinse (deionized water with an electrical conductivity ≦0.2 microSiemens per centimeter): ambient temperature, 20 seconds, spray (7) Drain/dry: 120 seconds, forced hot air at 90° C.

(8) Cationic electrocoating to a film thickness of about 20 μm, then bake for 20 minutes at 180° C.

(9) Surface coating with a film thickness of about 40 μm baked for 20 minutes at 140 ° C.

(10 ) Top coating with a film thickness of about 40 μm baked for 20 minutes at 140° C.

Test and Other Evaluation Methods

The coating appearance was evaluated on the following two-level scale (after operation (7) as described above:

+: the coating was uniform;

x: the coating exhibited a significant lack of uniformity with visible voids.

The test conditions and evaluation scale for the secondary (water-resistant) adherence were as follows: The sheet after operation (10) as described above was immersed for 240 hours in a hot water bath (maintained at 40° C.) that was being bubbled with air. The sheet was allowed to stand for 2 hours after removal from the hot water bath, after which time the peeling behavior was evaluated by cutting a grid (2 mm on each edge) in the sheet and subjecting this to tape peeling. The peeling behavior was evaluated using the following three-level scale:

++: complete absence of peeling;

+: some peeling observed at the edges of the grid cut;

x: substantial peeling.

The test conditions and evaluation scale for the hot saltwater immersion test were as follows. A cross cut was scribed with an acrylic cutter in the sheet after operation (8) as described above, and the specimen thus prepared was immersed for 240 hours in a 5% by weight solution of sodium chloride in water that was maintained at 55° C. and was bubbled with air. The specimen was allowed to stand for 1 hour after withdrawal from the saltwater bath, after which time the cross cut was peeled with tape and the width of peeling from the cut was evaluated. The peeling behavior was evaluated using the following three-level scale:

For the CRS:

++: maximum peel width (both sides) less than 4 mm;

+: maximum peel width (both sides) at least 4 mm but less than 6 mm;

x: maximum peel width (both sides) at least 6 mm.

For the EG: and GA:

++: maximum peel width (one side) less than 3 mm;

+: maximum peel width (one side) at least 3 mm but less than 5 mm;

x: maximum peel width (one side) at least 5 mm.

The test conditions and evaluation scale for salt spray testing were as follows: A cross cut was scribed with an acrylic cutter in the sheet after operation (8) as described above, and the specimen thus prepared was tested using a salt spray tester (5% by weight solution of sodium chloride in water) maintained at 35° C. After the stipulated time (based on Japanese Industrial Standard Z-2371), the specimen was rinsed with water and the status of corrosion at the cross cut was evaluated using the following three-level scale:

For the CRS (salt spray test time=960 hours):

++: maximum rust width (both sides) less than 4 mm;

+: maximum rust width (both sides) at least 4 mm but less than 5 mm;

x: maximum rust width (both sides) at least 5 mm.

For the EG and GA (salt spray test time=480 hours):

++: maximum rust width (one side) less than 4 mm;

+: maximum rust width (one side) at least 4 mm but less than 5 mm;

x: maximum rust width (one side) at least 5 mm.

Details of the surface conditioning processes and phosphate treatment processes for the Examples and Comparative Examples and the corresponding test results are reported in the following tables, in which the following abbreviations are used:

for the phosphate salt component:

Zn2FeP2=$Zn_2Fe(PO_4)_2.4H_2O$

Zn3P2=$Zn_3(PO_4)_2.4H_2O$

Zn2CaP2=$Zn_2Ca(PO_4)_2.4H_2O$ for the surfactant component:

EO11NPE=polyoxyethylene (EO: 11) nonylphenol ether for the phosphorus compounds:

ATMPA=aminotrinmethylenephosphonic acid

1-HEDPA=1-hydroxyethylidene1,1-diphosphonic acid

2-HEDPA=2-hydroxyethylidene-1,1-diphosphonic acid

EDATMPA=ethylenediaminetetramethylenephosphonic acid.

other:

Deg.=Degree

Polym.=Polymerization

Ex.=Example

Comp. Ex.=Comparative Example

VA=vinyl acetate

PVAc=polyvinylalcohol

Wt%=Percent by weight.

TABLE 1

EXAMPLES 1 TO 5

| | Example Number: | | | | |
|---|---|---|---|---|---|
| | 1 | 2 | 3 | 4 | 5 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn2FeP2 | Zn2FeP2 | Zn2FeP2 | Zn2FeP2 |
| Particle size, $\mu$m | 0.5 | 0.5 | 0.5 | 0.5 | 0.5 |
| Concentration, g/l | 1 | 1 | 1 | 1 | 1 |
| Saccharide-Based Constituents: | | | | | |
| Monosaccharide Unit | glucose | glucose | glucose | glucose | fructose |
| Substituent(s) | $CH_2COOH$ $NO_2$ | $CH_2COOH$ $NO_2$ | $CH_2COOH$ | none | none |
| Deg. of Substitution | ≦1.8 | ≦1.8 | 0.7 | none | 0 |
| Deg. of Polym. | ≦3,000 | ≦3,000 | ≦100 | 1 | ≦100 |
| Concentration, ppm | 5 | 1,000 | 10 | 2,000 | 2,000 |
| Salt constituent(s): | | | | | |
| Chemical Formula | none | none | $NaNO_2$ | $MgSO_4.7H_2O$ | none |
| Concentration, g/l | none | none | 0.5 | 0.5 | none |
| Surfactant Constituents: | | | | | |
| Abbreviation | none | none | none | none | none |
| Concentration, g/l | none | none | none | none | none |
| Treatment Temperature, ° C. | 20 | 20 | 20 | 20 | 20 |
| Treatment Time, Seconds | 30 | 30 | 30 | 30 | 30 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |
| $NH_4OH$ | none | 1.5 | none | 3.0 | none |
| Treatment Temperature, ° C. | 40 | 45 | 50 | 35 | 43 |
| Treatment Time, Seconds | 120 | 120 | 120 | 120 | 120 |

TABLE 2

EXAMPLES 6 TO 10

| | Example Number: | | | | |
|---|---|---|---|---|---|
| | 6 | 7 | 8 | 9 | 10 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn3P2 | Zn3P2 | Zn2CaP2 | Zn2CaP2 |
| Particle size, $\mu$m | 0.5 | 0.6 | 1.2 | 0.4 | 0.4 |
| Concentration, g/l | 1 | 1 | 1 | 10 | 5 |

TABLE 2-continued

| EXAMPLES 6 TO 10 | Example Number: | | | | |
|---|---|---|---|---|---|
| | 6 | 7 | 8 | 9 | 10 |
| Saccharide-Based Constituents: | | | | | |
| Monosaccharide Unit | glucose xylose galactose | glucose | glucose | glucose | fructose |
| Substituent(s) | none | $CH_2COOH$ | $CH_2COOH$ $CH_3$ | $CH_2COOH$ | none |
| Deg. of Substitution | 0 | ≧2 | 1.9 | 1.0 | 0 |
| Deg. of Polym. | ≦500 | ≦200 | ≦1,000 | ≦2,000 | ≦500 |
| Concentration, ppm | 100 | 100 | 1 | 10 | 5 |
| Salt constituent(s): | | | | | |
| Chemical Formula | none | none | $Na_2O.SiO_2.5H_2O$ | $Na_2CO_3$ | $Na_3PO_4.12H_2O$ |
| Concentration, g/l | none | none | 5 | 1 | 10 |
| Surfactant Constituents: | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 11 | 15 | 22 | 18 | 16 |
| $Zn^{2+}$ | 0.9 | 1.3 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | none | none |
| $Ca^{2+}$ | none | none | none | 1.0 | none |
| $Sr^{2+}$ | none | none | none | none | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 38 | 43 | 49 | 55 | 59 |
| Treatment Time, Seconds | 120 | 120 | 120 | 120 | 120 |

TABLE 3

| COMPARATIVE EXAMPLES 1 TO 5 | Comparative Example Number: | | | | |
|---|---|---|---|---|---|
| | 1 | 2 | 3 | 4 | 5 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn3P2 | Zn3P2 | Zn3P2 | Zn3P2 |
| Particle size, μm | 0.5 | 0.6 | 1.2 | 0.5 | 0.5 |
| Concentration, g/l | 1 | 1 | 1 | 1 | 1 |
| Saccharide-Based Constituents: | | | | | |
| Monosaccharide Unit | glucose xylose galactose | glucose | glucose | glucose | fructose |
| Substituent(s) | none | $CH_2COOH$ | $CH_2COOH$ $CH_3$ | none | none |
| Deg. of Substitution | 0 | ≧2 | 1.9 | none | none |
| Deg. of Polym. | ≦500 | ≦200 | ≦1,000 | 1 | ≦100 |
| Concentration, ppm | 100 | 100 | 1 | 2000 | 2000 |

TABLE 3-continued

| COMPARATIVE EXAMPLES 1 TO 5 | Comparative Example Number: | | | | |
|---|---|---|---|---|---|
| | 1 | 2 | 3 | 4 | 5 |
| Salt constituent(s): | | | | | |
| Chemical Formula | none | none | $Na_2O.SiO_2.5H_2O$ | $MgSO_4.7H_2O$ | none |
| Concentration, g/l | none | none | 5 | 0.5 | none |
| Surfactant Constituents: | | | | | |
| Abbreviation | none | none | none | none | none |
| Concentration, g/l | none | none | none | none | none |
| Treatment Temperature, ° C. | 20 | 20 | 20 | 20 | 20 |
| Treatment Time, Seconds | 30 | 30 | 30 | 30 | 30 |
| Phosphate Conversion Treatment Composition Constituents and Process Conditions: | | | | | |
| Grams per Liter of: | | | | | |
| $PO_4^{3-}$ | 11 | 15 | 1.0 | 18 | 16 |
| $Zn^{2+}$ | 0.1 | 7.0 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | 1.0 | none |
| $Ca^{2+}$ | none | none | none | none | none |
| $Sr^{2+}$ | none | none | none | 3.0 | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 38 | 43 | 49 | 55 | 20 |
| Treatment Time, Seconds | 120 | 120 | 120 | 120 | 120 |

TABLE 4

| COMPARATIVE EXAMPLES 6 TO 10 | Comparative Example Number: | | | | |
|---|---|---|---|---|---|
| | 6 | 7 | 8 | 9 | 10 |
| Surface Conditioning Treatment Composition Constituents and Process Conditions: | | | | | |
| PREPALENE ®-ZN, g/l | 1 | none | none | none | none |
| Phosphate Particles: | | | | | |
| Abbreviation | none | Zn3P2 | Zn3P2 | Zn2CaP2 | Zn2FeP2 |
| Particle size, μm | none | 0.6 | 6.5 | 0.4 | 0.5 |
| Concentration, g/l | none | 1 | 1 | 10 | 0.00001 |
| Saccharide-Based Constituents: | | | | | |
| Monosaccharide Unit | none | none | glucose | glucose | glucose |
| Substituent(s) | none | none | $CH_2COOH$ $CH_3$ | $CH_2COOH$ | $CH_2COOH$ |
| Deg. of Substitution | none | none | 1.9 | 1.0 | 0.7 |
| Deg. of Polym. | none | none | ≦1,000 | ≦2,000 | ≦100 |
| Concentration, ppm | none | none | 1 | 5,000 | 10 |
| Salt constituent(s): | | | | | |
| Chemical Formula | none | none | $Na_2O.SiO_2.5H_2O$ | $Na_2CO_3$ | $NaNO_2$ |
| Concentration, g/l | none | none | 5 | 1 | 0.5 |
| Surfactant Constituents: | | | | | |
| Abbreviation | none | none | none | none | none |
| Concentration, g/l | none | none | none | none | none |
| Treatment Temperature, ° C. | 20 | 20 | 20 | 20 | 20 |
| Treatment Time, Seconds | 30 | 30 | 30 | 30 | 30 |
| Phosphate Conversion Treatment | | | | | |

TABLE 4-continued

| COMPARATIVE EXAMPLES 6 TO 10 | | | | | |
|---|---|---|---|---|---|
| | Comparative Example Number: | | | | |
| | 6 | 7 | 8 | 9 | 10 |
| Composition Constituents and Process Conditions: | | | | | |
| Grams per Liter of: | | | | | |
| $PO_4^{3-}$ | 11 | 15 | 22 | 18 | 16 |
| $Zn^{2+}$ | 0.9 | 1.3 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | none | none |
| $Ca^{2+}$ | none | none | none | 1.0 | none |
| $Sr^{2+}$ | none | none | none | none | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 40 | 45 | 50 | 39 | 43 |
| Treatment Time, Seconds | 120 | 120 | 120 | 120 | 120 |

TABLE 5

APPEARANCE OF THE CONVERSION COATING AND RESULTS OF PAINTING PERFORMANCE TESTING FOR EXAMPLES 1 THROUGH 10

| TEST OR OTHER RATING | SUBSTRATE TESTED | EXAMPLE NUMBER 1 | 2 | 3 | 4 | 5 | 6 | 7 | 8 | 9 | 10 |
|---|---|---|---|---|---|---|---|---|---|---|---|
| Coating Appearance | CRS | + | + | + | + | + | + | + | + | + | + |
| | EG | + | + | + | + | + | + | + | + | + | + |
| | GA | + | + | + | + | + | + | + | + | + | + |
| Secondary (Water-Resistant) Adherence | CRS | ++ | ++ | ++ | ++ | ++ | ++ | ++ | ++ | ++ | ++ |
| | EG | ++ | ++ | + | ++ | ++ | ++ | ++ | + | ++ | ++ |
| | GA | ++ | ++ | + | ++ | ++ | ++ | ++ | + | ++ | ++ |
| Resistance to Hot Salt Water | CRS | ++ | ++ | ++ | ++ | + | ++ | + | ++ | ++ | + |
| | EG | ++ | ++ | ++ | ++ | ++ | ++ | + | ++ | ++ | ++ |
| | GA | ++ | ++ | ++ | ++ | ++ | ++ | + | ++ | ++ | ++ |
| Resistance to Salt Spray | CRS | + | ++ | ++ | + | + | + | + | + | ++ | + |
| | EG | ++ | + | ++ | + | ++ | ++ | + | + | ++ | ++ |
| | GA | ++ | + | ++ | + | ++ | ++ | + | + | ++ | ++ |

TABLE 6

APPEARANCE OF THE CONVERSION COATING AND RESULTS OF PAINTING PERFORMANCE TESTING FOR COMPARISON EXAMPLES 1 THROUGH 10

| TEST OR OTHER RATING | SUBSTRATE TESTED | COMPARISON EXAMPLE NUMBER 1 | 2 | 3 | 4 | 5 | 6 | 7 | 8 | 9 | 10 |
|---|---|---|---|---|---|---|---|---|---|---|---|
| Coating Appearance | CRS | × | + | × | × | × | + | × | × | × | × |
| | EG | × | + | × | × | × | + | × | × | × | + |
| | GA | × | + | × | × | × | + | × | × | × | + |
| Secondary (Water-Resistant) Adherence | CRS | ++ | + | ++ | ++ | ++ | + | ++ | ++ | ++ | + |
| | EG | × | × | × | × | × | × | × | × | × | × |
| | GA | × | × | × | × | × | × | × | × | × | × |
| Resistance to Hot Salt Water | CRS | × | ++ | × | × | × | ++ | × | × | × | × |
| | EG | × | + | × | × | × | + | × | × | × | + |
| | GA | × | + | × | × | × | + | × | × | × | + |
| Resistance to Salt Spray | CRS | × | × | × | × | × | × | × | × | × | × |
| | EG | × | + | × | × | × | + | × | × | × | × |
| | GA | × | × | × | × | × | × | × | × | × | × |

TABLE 7

EXAMPLES 11 TO 15

| | Example Number: | | | | |
|---|---|---|---|---|---|
| | 11 | 12 | 13 | 14 | 15 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn3P2 | Zn3P2 | Zn2CaP2 | Zn2FeP2 |
| Particle size, $\mu$m | 0.5 | 0.5 | 1.7 | 0.6 | 0.5 |
| Concentration, g/l | 5 | 1 | 1 | 5 | 10 |
| Phosphorus Containing Solute: | | | | | |
| Substance | tripoly-phosphoric acid | hexameta-phosphoric acid | ATMPA | 1-HEDPA | EDATMPA |
| Concentration, ppm | 1 | 100 | 500 | 50 | 1,000 |
| Salt constituent(s): | | | | | |
| Chemical Formula | $MgSO_4.7H_2O$ | $Na_2O.SiO_2.5H_2O$ | none | $Na_2CO_3$ | $Na_3PO_4.12H_2O$ |
| Concentration, g/l | 0.5 | 1 | none | 5 | 10 |
| Surfactant Constituents: | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |
| $NH_4OH$ | none | 1.5 | none | 3.0 | none |
| Treatment Temperature, ° C. | 40 | 45 | 50 | 39 | 43 |
| Treatment Time, Seconds | 120 | 120 | 120 | 120 | 120 |

TABLE 8

COMPARATIVE EXAMPLES 11 TO 15

| | Comparative Example Number: | | | | |
|---|---|---|---|---|---|
| | 11 | 12 | 13 | 14 | 15 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn3P2 | Zn3P2 | Zn2CaP2 | Zn2FeP2 |
| Particle size, $\mu$m | 0.5 | 0.5 | 1.7 | 0.6 | 0.5 |
| Concentration, g/l | 5 | 1 | 1 | 5 | 10 |

TABLE 8-continued

| | COMPARATIVE EXAMPLES 11 TO 15 | | | | |
|---|---|---|---|---|---|
| | Comparative Example Number: | | | | |
| | 11 | 12 | 13 | 14 | 15 |
| Phosphorus Containing Solute: | | | | | |
| Substance | tripoly-phosphoric acid | hexameta-phosphoric acid | ATMPA | 2-HEDPA | EDATMPA |
| Concentration, ppm | 1 | 100 | 500 | 50 | 1,000 |
| Salt constituent(s): | | | | | |
| Chemical Formula | $MgSO_4.7H_2O$ | NaOH | none | $Na_2CO_3$ | $Na_3PO_4.12H_2O$ |
| Concentration, g/l | 0.5 | 1 | none | 5 | 10 |
| Surfactant Constituents: | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 11 | 15 | 1.0 | 18 | 16 |
| $Zn^{2+}$ | 0.1 | 7.0 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | 1.0 | none |
| $Ca^{2+}$ | none | none | none | none | none |
| $Sr^{2+}$ | none | none | none | 3.0 | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 40 | 45 | 50 | 39 | 20 |
| Treatment Time, Seconds | 120 | 120 | 120 | 120 | 120 |

TABLE 9

| | COMPARATIVE EXAMPLES 16 TO 20 | | | | |
|---|---|---|---|---|---|
| | Comparative Example Number: | | | | |
| | 16 | 17 | 18 | 19 | 20 |
| Surface Conditioning Treatment Composition Constituents and Process Conditions: | | | | | |
| PREPALENE ®-ZN, g/l | 1 | none | none | none | none |
| Phosphate Particles | | | | | |
| Abbreviation | none | Zn3P2 | Zn3P2 | Zn2CaP2 | Zn2FeP2 |
| Particle size, μm | none | 0.5 | 6.5 | 0.6 | 0.00001 |
| Concentration, g/l | none | 1 | 1 | 5 | 10 |
| Phosphorus Containing Solute | | | | | |
| Substance | none | none | ATMPA | hexametaphos-phoric acid | EDATMPA |
| Concentration, ppm | none | none | 500 | 3,000 | 1,000 |
| Salt constituent(s) | | | | | |
| Chemical Formula | $MgSO_4.7H_2O$ | none | none | $Na_2CO_3$ | $Na_2O.SiO_2.5H_2O$ |
| Concentration, g/l | 0.5 | none | none | 5 | 1 |
| Surfactant Constituents | | | | | |
| Abbreviation | none | none | none | none | EO11NPE |
| Concentration, g/l | none | none | none | none | 2.0 |

TABLE 9-continued

| COMPARATIVE EXAMPLES 16 TO 20 | Comparative Example Number: | | | | |
|---|---|---|---|---|---|
| | 16 | 17 | 18 | 19 | 20 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 11 | 15 | 22 | 18 | 16 |
| $Zn^{2+}$ | 0.9 | 1.3 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | none | none |
| $Ca^{2+}$ | none | none | none | 1.0 | none |
| $Sr^{2+}$ | none | none | none | none | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 40 | 45 | 50 | 39 | 43 |
| Treatment Time, Seconds | 120 | 120 | 120 | 120 | 120 |

TABLE 10

APPEARANCE OF THE CONVERSION COATING AND RESULTS OF PAINTING PERFORMANCE TESTING FOR EXAMPLES 11 THROUGH 15

| TEST OR OTHER RATING | SUBSTRATE TESTED | EXAMPLE NUMBER 11 | 12 | 13 | 14 | 15 |
|---|---|---|---|---|---|---|
| Coating Appearance | CRS | + | + | + | + | + |
| | EG | + | + | + | + | + |
| | GA | + | + | + | + | + |
| Secondary (Water-Resistant) Adherence | CRS | ++ | ++ | ++ | ++ | ++ |
| | EG | ++ | ++ | + | ++ | ++ |
| | GA | ++ | ++ | + | ++ | ++ |
| Resistance to Hot Salt Water | CRS | ++ | ++ | ++ | ++ | + |
| | EG | ++ | ++ | ++ | ++ | ++ |
| | GA | ++ | ++ | ++ | ++ | ++ |
| Resistance to Salt Spray | CRS | + | ++ | ++ | + | + |
| | EG | ++ | + | ++ | + | ++ |
| | GA | ++ | + | ++ | + | ++ |

TABLE 11

APPEARANCE OF THE CONVERSION COATING AND RESULTS OF PAINTING PERFORMANCE TESTING FOR COMPARISON EXAMPLES 11 THROUGH 20

| TEST OR OTHER RATING | SUBSTRATE TESTED | COMPARISON EXAMPLE NUMBER 11 | 12 | 13 | 14 | 15 | 16 | 17 | 18 | 19 | 20 |
|---|---|---|---|---|---|---|---|---|---|---|---|
| Coating Appearance | CRS | × | + | × | × | × | + | × | × | × | × |
| | EG | × | + | × | × | × | + | × | × | × | + |
| | GA | × | + | × | × | × | + | × | × | × | + |
| Secondary (Water-Resistant) Adherence | CRS | ++ | + | ++ | ++ | ++ | + | ++ | ++ | ++ | + |
| | EG | × | × | × | × | × | × | × | × | × | × |
| | GA | × | × | × | × | × | × | × | × | × | × |

TABLE 11-continued

APPEARANCE OF THE CONVERSION COATING AND RESULTS OF PAINTING PERFORMANCE TESTING FOR COMPARISON EXAMPLES 11 THROUGH 20

| TEST OR OTHER RATING | SUBSTRATE TESTED | COMPARISON EXAMPLE NUMBER 11 | 12 | 13 | 14 | 15 | 16 | 17 | 18 | 19 | 20 |
|---|---|---|---|---|---|---|---|---|---|---|---|
| Resistance to Hot Salt Water | CRS | × | ++ | × | × | × | ++ | × | × | × | × |
| | EG | × | + | × | × | × | + | × | × | × | + |
| | GA | × | + | × | × | × | + | × | × | × | + |
| Resistance to Salt Spray | CRS | × | × | × | × | × | × | × | × | × | × |
| | EG | × | + | × | × | × | + | × | × | × | × |
| | GA | × | × | × | × | × | × | × | × | × | × |

TABLE 12

EXAMPLES 16 TO 20

| | Example Number: 16 | 17 | 18 | 19 | 20 |
|---|---|---|---|---|---|
| Surface Conditioning Treatment Composition Constituents and Process Conditions: | | | | | |
| PREPALENE ®-ZN, g/l | none | none | none | none | none |
| Phosphate Particles | | | | | |
| Abbreviation | Zn2FeP2 | Zn3P2 | Zn3P2 | Zn2CaP2 | Zn2FeP2 |
| Particle size, μm | 0.5 | 1.5 | 0.5 | 1.6 | 0.3 |
| Concentration, g/l | 5 | 8 | 1 | 5 | 10 |
| Water Soluble VA Polymer or Derivative | | | | | |
| Substance Name | polyvinyl alcohol | carboxyl-modified PV Alc | sulfonic acid-modified PV Alc | Copolymer with VA | Copolymer with VA |
| Comonomer with VA | none | none | none | maleic acid | crotonic acid |
| Comonomer % by Weight | none | none | none | 80 | 70 |
| Concentration, ppm | 1 | 500 | 2,000 | 1,000 | 10 |
| Salt constituent(s) | | | | | |
| Chemical Formula | $MgSO_4.7H_2O$ | $Na_2O.SiO_2.5H_2O$ | none | $Na_2CO_3$ | $Na_3PO_4.12H_2O$ |
| Concentration, g/l | 0.5 | 1 | none | 5 | 10 |
| Surfactant Constituents | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |
| $NH_4OH$ | none | 1.5 | none | 3.0 | none |
| Treatment Temperature, ° C. | 40 | 45 | 50 | 39 | 43 |
| Treatment Time, Seconds | 120 | 120 | 120 | 120 | 120 |

TABLE 13

COMPARATIVE EXAMPLES 21 TO 25

| | Comparative Example Number: | | | | |
|---|---|---|---|---|---|
| | 21 | 22 | 23 | 24 | 25 |
| Surface Conditioning Treatment Composition Constituents and Process Conditions: | | | | | |
| PREPALENE ®-ZN, g/l | none | none | none | none | none |
| Phosphate Particles: | | | | | |
| Abbreviation | Zn2FeP2 | Zn3P2 | Zn3P2 | Zn2CaP2 | Zn3P2 |
| Particle size, $\mu$m | 0.5 | 0.5 | 0.5 | 1.6 | 0.5 |
| Concentration, g/l | 5 | 1 | 1 | 5 | 1 |
| Water Soluble VA Polymer or Derivative: | | | | | |
| Substance Name | polyvinyl-alcohol | carboxyl-modified PV Alc | sulfonic acid-modified PV Alc | Copolymer with VA | Copolymer with VA |
| Comonomer with VA | none | none | none | maleic acid | crotonic acid |
| Comonomer % by Weight | none | none | none | 80 | 70 |
| Concentration, ppm | 1 | 500 | 2,000 | 1,000 | 10 |
| Salt constituent(s): | | | | | |
| Chemical Formula | $MgSO_4.7H_2O$ | $Na_2O.SiO_2.5H_2O$ | none | $Na_2CO_3$ | $Na_3PO_4.12H_2O$ |
| Concentration, g/l | 0.5 | 1 | none | 5 | 10 |
| Surfactant Constituents: | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 11 | 15 | 1.0 | 18 | 16 |
| $Zn^{2+}$ | 0.1 | 7.0 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | 1.0 | none |
| $Ca^{2+}$ | none | none | none | none | none |
| $Sr^{2+}$ | none | none | none | 3.0 | 0.9 |
| $WO_4^{-2}$ | none | none | 0.3 | none | none |
| $NO_3^-$ | 8.9 | 7.6 | 9.0 | 8.0 | 7.3 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 40 | 45 | 50 | 39 | 20 |
| Treatment Time, Seconds | 120 | 120 | 120 | 120 | 120 |

TABLE 14

COMPARATIVE EXAMPLES 26 TO 30

| | Comparative Example Number: | | | | |
|---|---|---|---|---|---|
| | 26 | 27 | 28 | 29 | 30 |
| Surface Conditioning Treatment Composition Constituents and Process Conditions: | | | | | |
| PREPALENE ®-ZN, g/l | 1 | none | none | none | none |
| Phosphate Particles: | | | | | |
| Abbreviation | none | Zn2FeP2 | Zn3P2 | Zn2CaP2 | Zn2FeP2 |
| Particle size, $\mu$m | none | 1.7 | 6.5 | 1.6 | 0.3 |
| Concentration, g/l | none | 7 | 1 | 5 | 0.00001 |

TABLE 14-continued

COMPARATIVE EXAMPLES 26 TO 30

| | Comparative Example Number: | | | | |
|---|---|---|---|---|---|
| | 26 | 27 | 28 | 29 | 30 |
| Water Soluble VA Polymer or Derivative: | | | | | |
| Substance Name | polyvinyl alcohol | none | sulfonic acid-modified PV Alc | Copolymer with VA | Copolymer with VA |
| Comonomer with VA | none | none | none | maleic acid | crotonic acid |
| Comonomer % by Weight | none | none | none | 80 | 70 |
| Concentration, ppm | 1 | none | 2,000 | 3,000 | 10 |
| Salt constituent(s): | | | | | |
| Chemical Formula | none | $Na_2O.SiO_2.5H_2O$ | none | $Na_2CO_3$ | $Na_3PO_4.12H_2O$ |
| Concentration, g/l | none | 1 | none | 5 | 10 |
| Surfactant Constituents: | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |
| $NH_4OH$ | none | 1.5 | none | 3.0 | none |
| Treatment Temperature, ° C. | 40 | 45 | 50 | 39 | 43 |
| Treatment Time, Seconds | 120 | 120 | 120 | 120 | 120 |

TABLE 15

APPEARANCE OF THE CONVERSION COATING AND RESULTS OF PAINTING PERFORMANCE TESTING FOR EXAMPLES 16 THROUGH 20

| TEST OR OTHER RATING | SUBSTRATE TESTED | EXAMPLE NUMBER 16 | 17 | 18 | 19 | 20 |
|---|---|---|---|---|---|---|
| Coating Appearance | CRS | + | + | + | + | + |
| | EG | + | + | + | + | + |
| | GA | + | + | + | + | + |
| Secondary (Water-Resistant) Adherence | CRS | ++ | ++ | ++ | ++ | ++ |
| | EG | ++ | ++ | + | ++ | ++ |
| | GA | ++ | ++ | + | ++ | ++ |
| Resistance to Hot Salt Water | CRS | ++ | ++ | ++ | ++ | + |
| | EG | ++ | ++ | ++ | ++ | ++ |
| | GA | ++ | ++ | ++ | ++ | ++ |
| Resistance to | CRS | + | ++ | ++ | + | + |

TABLE 15-continued

APPEARANCE OF THE CONVERSION COATING AND RESULTS OF PAINTING PERFORMANCE TESTING FOR EXAMPLES 16 THROUGH 20

| TEST OR OTHER RATING | SUBSTRATE TESTED | EXAMPLE NUMBER 16 | 17 | 18 | 19 | 20 |
|---|---|---|---|---|---|---|
| Salt Spray | EG | ++ | + | ++ | + | ++ |
| | GA | ++ | + | ++ | + | ++ |

TABLE 16

APPEARANCE OF THE CONVERSION COATING AND RESULTS OF PAINTING PERFORMANCE TESTING FOR COMPARISON EXAMPLES 21 THROUGH 30

| TEST OR OTHER RATING | SUBSTRATE TESTED | COMPARISON EXAMPLE NUMBER 21 | 22 | 23 | 24 | 25 | 26 | 27 | 28 | 29 | 30 |
|---|---|---|---|---|---|---|---|---|---|---|---|
| Coating Appearance | CRS | × | + | × | × | × | + | × | × | × | × |
| | EG | × | + | × | × | × | + | × | × | × | + |
| | GA | × | + | × | × | × | + | × | × | × | + |
| Secondary (Water-Resistant) Adherence | CRS | ++ | + | ++ | ++ | ++ | + | ++ | ++ | ++ | + |
| | EG | × | × | × | × | × | × | × | × | × | × |
| | GA | × | × | × | × | × | × | × | × | × | × |
| Resistance to Hot Salt Water | CRS | × | ++ | × | × | × | ++ | × | × | × | × |
| | EG | × | + | × | × | × | + | × | × | × | + |
| | GA | × | + | × | × | × | + | × | × | × | + |
| Resistance to Salt Spray | CRS | × | × | × | × | × | × | × | × | × | × |
| | EG | × | + | × | × | × | + | × | × | × | × |
| | GA | × | × | × | × | × | × | × | × | × | × |

TABLE 17

EXAMPLES 21 TO 25 with Type (4) Polymer Adhesion Promoting Agents

| | Example Number: 21 | 22 | 23 | 24 | 25 |
|---|---|---|---|---|---|
| Surface Conditioning Treatment Composition Constituents and Process Conditions: | | | | | |
| PREPALENE ®-ZN, g/l | none | none | none | none | none |
| Phosphate Particles | | | | | |
| Abbreviation | Zn2FeP2 | Zn3P2 | Zn3P2 | Zn2CaP2 | Zn2FeP2 |
| Particle size, μm | 0.5 | 0.5 | 1.7 | 0.6 | 0.5 |
| Concentration, g/l | 5 | 1 | 1 | 5 | 10 |
| Monomer with Formula (I) | | | | | |
| $R^1$ | H | none | none | $CH_3$ | none |
| $R^2$ | $C_2H_4OH$ | none | none | $C_3H_7OH$ | none |
| Wt % in Polymer | 100 | none | none | 20 | none |
| Other Unsaturated Acid Monomer | | | | | |
| Monomer Name | none | maleic acid | acrylic acid | maleic acid | methacrylic acid |
| Wt % in Polymer | none | 80 | 100 | 80 | 50 |
| Other Comonomer | | | | | |
| Monomer Name | none | vinyl acetate | none | none | styrene-sulfonic acid |
| Wt % in Polymer | none | 20 | none | none | 50 |
| Polymer Concentration, ppm | 1 | 500 | 2,000 | 1,500 | 5 |
| Salt constituent(s) | | | | | |
| Chemical Formula | $MgSO_4.7H_2O$ | $Na_2O.SiO_2.5H_2O$ | none | KOH | $Na_3PO_4.12H_2O$ |
| Concentration, g/l | 0.5 | 1 | none | 5 | 10 |
| Surfactant Constituents | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |

TABLE 17-continued

EXAMPLES 21 TO 25 with Type (4) Polymer Adhesion Promoting Agents

| | Example Number: | | | | |
|---|---|---|---|---|---|
| | 21 | 22 | 23 | 24 | 25 |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |
| $NH_4OH$ | none | 1.5 | none | 3.0 | none |
| Treatment Temperature, ° C. | 40 | 45 | 50 | 39 | 43 |
| Treatment Time, Seconds | 120 | 120 | 120 | 120 | 120 |

TABLE 18

COMPARATIVE EXAMPLES 31 TO 35

| | Comparative Example Number: | | | | |
|---|---|---|---|---|---|
| | 31 | 32 | 33 | 34 | 35 |
| Surface Conditioning Treatment Composition Constituents and Process Conditions: | | | | | |
| PREPALENE ®-ZN, g/l | none | none | none | none | none |
| Phosphate Particles | | | | | |
| Abbreviation | Zn2FeP2 | Zn3P2 | Zn3P2 | Zn2CaP2 | Zn2FeP2 |
| Particle size, $\mu$m | 0.5 | 0.5 | 1.7 | 0.6 | 0.5 |
| Concentration, g/l | 5 | 1 | 1 | 5 | 10 |
| Monomer with Formula (I) | | | | | |
| $R^1$ | H | none | none | $CH_3$ | none |
| $R^2$ | $C_2H_4OH$ | none | none | $C_3H_7OH$ | none |
| Wt % in Polymer | 100 | none | none | 20 | none |
| Other Unsaturated Acid Monomer | | | | | |
| Monomer Name | none | maleic acid | acrylic acid | maleic acid | methacrylic acid |
| Wt % in Polymer | none | 80 | 100 | 80 | 50 |
| Other Comonomer | | | | | |
| Monomer Name | none | vinyl acetate | none | none | styrene-sulfonic acid |
| Wt % in Polymer | none | 20 | none | none | 50 |
| Polymer Concentration, ppm | 1 | 500 | 2,000 | 1,500 | 5 |
| Salt constituent(s) | | | | | |
| Chemical Formula | $MgSO_4.7H_2O$ | $Na_2O.SiO_2.5H_2O$ | none | $Na_2CO_3$ | $Na_3PO_4.12H_2O$ |
| Concentration, g/l | 0.5 | 1 | none | 5 | 10 |
| Surfactant Constituents | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 11 | 15 | 1.0 | 18 | 16 |
| $Zn^{2+}$ | 0.1 | 7.0 | 2.0 | 1.5 | 1.4 |
| $Mg^{2+}$ | 2.0 | none | none | none | 2.5 |
| $Co^{2+}$ | none | none | none | none | none |
| $Mn^{2+}$ | 0.6 | none | 1.0 | 1.0 | none |
| $Ca^{2+}$ | none | none | none | none | none |
| $Sr^{2+}$ | none | none | none | 3.0 | 0.9 |
| $WO_4^{-2}$ | none | none | 0.3 | none | none |
| $NO_3^-$ | 8.9 | 7.6 | 9.0 | 8.0 | 7.3 |

TABLE 18-continued

| COMPARATIVE EXAMPLES 31 TO 35 | | | | | |
|---|---|---|---|---|---|
| | Comparative Example Number: | | | | |
| | 31 | 32 | 33 | 34 | 35 |
| $F^-$ | 0.1 | none | 0.1 | none | 0.1 |
| $NO_2^-$ | 0.01 | none | 0.01 | none | none |
| $NH_4OH$ | none | 1.5 | none | 3.0 | 3.5 |
| Treatment Temperature, ° C. | 40 | 45 | 50 | 39 | 20 |
| Treatment Time, Seconds | 120 | 120 | 120 | 120 | 120 |

TABLE 19

| COMPARATIVE EXAMPLES 36 TO 40 | | | | | |
|---|---|---|---|---|---|
| | Comparative Example Number: | | | | |
| | 36 | 37 | 38 | 39 | 40 |
| Surface Conditioning Treatment Composition Constituents and Process Conditions: | | | | | |
| PREPALENE ®-ZN, g/l | 1 | none | none | none | none |
| Phosphate Particles | | | | | |
| Abbreviation | none | Zn2CaP2 | Zn3P2 | Zn2CaP2 | Zn2FeP2 |
| Particle size, μm | none | 0.8 | 6.8 | 0.6 | 0.5 |
| Concentration, g/l | none | 10 | 1 | 5 | 0.0001 |
| Monomer with Formula (I) | | | | | |
| $R^1$ | H | none | none | $CH_3$ | none |
| $R^2$ | $C_2H_4OH$ | none | none | $C_3H_7OH$ | none |
| Wt % in Polymer | 100 | none | none | 20 | none |
| Other Unsaturated Acid Monomer | | | | | |
| Monomer Name | none | none | acrylic acid | maleic acid | methacrylic acid |
| Wt % in Polymer | none | none | 100 | 80 | 50 |
| Other Comonomer | | | | | |
| Monomer Name | none | none | none | none | styrenesulfonic acid |
| Wt % in Polymer | none | none | none | none | 50 |
| Polymer Concentration, ppm | 1 | none | 2,000 | 3,000 | 5 |
| Salt constituent(s) | | | | | |
| Chemical Formula | $MgSO_4 \cdot 7H_2O$ | $Na_2O.SiO_2 \cdot 5H_2O$ | none | $Na_2CO_3$ | $Na_3PO_4 \cdot 12H_2O$ |
| Concentration, g/l | 0.5 | 1 | none | 5 | 10 |
| Surfactant Constituents | | | | | |
| Abbreviation | none | none | none | none | EO11NPE |
| Concentration, g/l | none | none | none | none | 2.0 |
| Treatment Temperature, ° C. | 20 | 20 | 20 | 20 | 40 |
| Treatment Time, Seconds | 30 | 30 | 30 | 30 | 120 |
| Phosphate Conversion Treatment Composition Constituents and Process Conditions: | | | | | |
| Grams per Liter of: | | | | | |
| $PO_4^{3-}$ | 10 | 15 | 20 | 18 | 16 |
| $Zn^{2+}$ | 0.8 | 1.3 | 2.2 | 1.5 | 1.4 |
| $Mg^{2+}$ | 2.0 | none | none | none | 2.5 |
| $Co^{2+}$ | none | 1.0 | none | none | none |
| $Mn^{2+}$ | 0.5 | none | 1.0 | none | none |
| $Ca^{2+}$ | none | none | none | 1.5 | none |
| $Sr^{2+}$ | none | none | none | none | 0.9 |
| $WO_4^{-2}$ | none | none | 0.3 | none | none |
| $NO_3^-$ | 8.3 | 7.6 | 9.0 | 8.0 | 7.3 |
| $F^-$ | 0.1 | none | 0.1 | none | 0.1 |
| $NO_2^-$ | 0.01 | none | 0.01 | none | 0.01 |

TABLE 19-continued

| COMPARATIVE EXAMPLES 36 TO 40 | | | | | |
|---|---|---|---|---|---|
| | Comparative Example Number: | | | | |
| | 36 | 37 | 38 | 39 | 40 |
| $NH_4OH$ | none | 1.5 | none | 3.0 | none |
| Treatment Temperature, ° C. | 40 | 45 | 50 | 39 | 43 |
| Treatment Time, Seconds | 120 | 120 | 120 | 120 | 120 |

TABLE 20

| APPEARANCE OF THE CONVERSION COATING AND RESULTS OF PAINTING PERFORMANCE TESTING FOR EXAMPLES 21 THROUGH 25 | | | | | | |
|---|---|---|---|---|---|---|
| TEST OR | SUBSTRATE | EXAMPLE NUMBER | | | | |
| OTHER RATING | TESTED | 21 | 22 | 23 | 24 | 25 |
| Coating | CRS | + | + | + | + | + |
| Appearance | EG | + | + | + | + | + |
| | GA | + | + | + | + | + |
| Secondary | CRS | ++ | ++ | ++ | ++ | ++ |
| (Water-Resistant) | EG | ++ | ++ | + | ++ | ++ |
| Adherence | GA | ++ | ++ | + | ++ | ++ |
| Resistance to | CRS | ++ | ++ | ++ | ++ | + |
| Hot Salt Water | EG | ++ | ++ | ++ | ++ | ++ |
| | GA | ++ | ++ | ++ | ++ | ++ |
| Resistance to | CRS | + | ++ | ++ | + | + |
| Salt Spray | EG | ++ | + | ++ | + | ++ |
| | GA | ++ | + | ++ | + | ++ |

TABLE 21

| APPEARANCE OF THE CONVERSION COATING AND RESULTS OF PAINTING PERFORMANCE TESTING FOR COMPARISON EXAMPLES 31 THROUGH 40 | | | | | | | | | | | |
|---|---|---|---|---|---|---|---|---|---|---|---|
| | SUBSTRATE | COMPARISON EXAMPLE NUMBER | | | | | | | | | |
| TEST OR OTHER RATING | TESTED | 31 | 32 | 33 | 34 | 35 | 36 | 37 | 38 | 39 | 40 |
| Coating Appearance | CRS | × | + | × | × | × | + | × | × | × | × |
| | EG | × | + | × | × | × | + | × | × | × | + |
| | GA | × | + | × | × | × | + | × | × | × | + |
| Secondary (Water-Resistant) | CRS | ++ | + | ++ | ++ | ++ | + | ++ | ++ | ++ | + |
| Adherence | EG | × | × | × | × | × | × | × | × | × | × |
| | GA | × | × | × | × | × | × | × | × | × | × |
| Resistance to Hot Salt Water | CRS | × | ++ | × | × | × | ++ | × | × | × | × |
| | EG | × | + | × | × | × | + | × | × | × | + |
| | GA | × | + | × | × | × | + | × | × | × | + |
| Resistance to Salt Spray | CRS | × | × | × | × | × | × | × | × | × | × |
| | EG | × | + | × | × | × | + | × | × | × | × |
| | GA | × | × | × | × | × | × | × | × | × | × |

What is claimed is:

1. A process for forming a phosphate conversion coating on a metal substrate surface, said process comprising the following operations:

(I) contacting the metal substrate surface with an aqueous liquid surface conditioning composition that comprises water and the following components:

(I.A) dispersed solid phosphate particles that:

(i) have a diameter no greater than 5 $\mu$m; and (ii) comprise at least one substance selected from the group consisting of phosphates that contain at least one type of divalent or trivalent metal cations; and (I.B) as adhesion-promoting component, at least one selection from the group consisting of the following subgroups:

(1) monosaccharides, polysaccharides, and derivatives thereof;

(2) phosphorus containing solutes selected from the group consisting of orthophosphoric acid, condensed phosphoric acids, and organophosphonic acid compounds;

(3) water-soluble polymers that are homopolymers or copolymers of vinyl acetate and derivatives of these homopolymers and copolymers; and (4) copolymers and polymers afforded by the polymerization of:

(a) at least one selection from:

monomers, exclusive of vinyl acetate, that conform to general chemical formula:

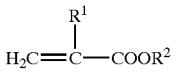

(I), where $R^1$=H or $CH_3$ and $R^2$=H, $C_1$ to $C_5$ alkyl, or $C_1$ to $C_5$ hydroxyalkyl; and other α, β-unsaturated carboxylic acid monomers; and, optionally, (b) not more than 50% by weight of monomers that are not vinyl acetate and are not within the description of part (a) immediately above but are copolymerizable with said monomers that are within the description of said part (a); and (II) contacting the metal substrate surface as conditioned in operation (I) as described above with a nickel-free phosphate conversion treatment bath that comprises water and the following amounts of the following components:

(II.A) from 0.5 to 5 g/l of zinc cations;

(II.B) from 5 to 30 g/l of phosphate ions; and (II.C) a component of conversion accelerator.

2. A process according to claim 1, wherein the phosphate conversion treatment bath also contains from 0.1 to 3.0 g/l of at least one type of ions selected from the group consisting of magnesium ions, cobalt ions, manganese ions, calcium ions, tungstate ions, and strontium ions.

3. A process according to claim 2, wherein the concentration of component (1.A) is from 0.001 to 30 g/l and the concentration of component (1.B) is form 1 to 2,000 ppm.

4. A process according to claim 1, wherein the concentration of component (1.A) is from 0.001 to 30 g/l and the concentration of component (1.B) is from 1 to 2,000 ppm.

5. The process of claim 1 wherein the divalent or trivalent metal cations are selected from the group consisting of Zn, Fe, Mn, Co, Ca, Mg and Al.

6. The process of claim 1 wherein the aqueous liquid surface conditioning composition has a concentration of dispersed solid phosphate particles of from 0.001 to 30 g/l.

7. The process of claim 1 wherein the aqueous liquid surface conditioning composition has a concentration of adhesion-promoting component of from 1 to 2000 ppm.

8. The process of claim 1 wherein the aqueous liquid surface conditioning composition is additionally comprised of an alkali metal or ammonium salt selected from the group consisting of orthophosphate salts, metaphosphate salts, orthosilicate salts, metasilicate salts, carbonate salts, bicarbonate salts, nitrate salts, nitrite salts, sulfate salts, borate salts, organic acid salts and mixtures thereof.

9. The process of claim 1 wherein the nickel-free phosphate conversion treatment bath is additionally comprised of an etchant selected from the group consisting of fluoride ions, complex fluoride ions, and mixtures thereof.

10. The process of claim 1 wherein the metal substrate is selected from the group consisting of steel sheets, zinc-plated steel sheets, zinc alloy-plated steel sheets, magnesium alloys, and aluminum alloys.

* * * * *